United States Patent [19]

Smith

[11] 4,359,742

[45] Nov. 16, 1982

[54] DUAL SWITCH MULTIMODE ARRAY ANTENNA

[75] Inventor: Peter W. Smith, Westport, Conn.

[73] Assignee: United Technologies Corporation, Hartford, Conn.

[21] Appl. No.: 219,745

[22] Filed: Dec. 23, 1980

[51] Int. Cl.[3] ..... H01Q 13/10

[52] U.S. Cl. ..... 343/768

[58] Field of Search ..... 343/767, 768, 769, 770, 343/771

[56] References Cited

U.S. PATENT DOCUMENTS 3,136,993 6/1964 Goldbohm ..... 343/771

3,893,124 7/1975 Barker ..... 343/768

*Primary Examiner*—Eli Lieberman

*Attorney, Agent, or Firm*—Richard P. Lange

[57] ABSTRACT

A dual switch multimode array antenna capable of being switched between two modes through the use of two waveguide switches and a pair of phase shifters. The first mode produces a pencil beam with a monopulse capability and the two switches divide the transmit power equally between the four quadrants. A monopulse capability exists both in azimuth and elevation in this first mode. With the switches and phase shifters transitioned to the second position, illuminated power is directed to the two quadrants and the upper half of the antenna only. This produces the well known $\text{cosec}^2\theta \cos\theta$ beam in elevation. An azimuth monopulse capability is available in this mode.

9 Claims, 5 Drawing Figures

POLAR PLOT OF RADIATION PATTERN - PENCIL BEAM

POLAR PLOT OF RADIATION PATTERN - $COSEC^2\,\theta\,COS\,\theta$ ELEVATION

POLAR PLOT OF RADIATION PATTERN-
MONOPULSE DIFFERENCE

DUAL SWITCH MULTIMODE ARRAY ANTENNA

DESCRIPTION

1. Technical Field

This invention relates to an array antenna for transmitting and receiving radar signals, and more particularly, to a planar array antenna having two switches and two phase shifters that is capable of monopulse operation in both a highly directive pencil beam mode and also a $\text{cosec}^2 \eta \cos \theta$ beam mode.

2. Background Art

Array antennas are known generally and comprise a plurality of radiating elements often positioned in a planar configuration. With some array antennas, the phase of a radar signal associated with the array elements may be electrically controlled by a plurality of phase shifters which are positioned in the path to each of the array elements so that the direction of the antenna beam can be scanned electronically.

The high frequency illuminating radar signal is typically produced by a transmitter whose output energy is presented to the antenna through a feed network. In that the radiating elements are typically formed on a flat surface, the direction or orientation of both the transmit and receive aperture is controlled by the phase of each of the radiating elements. In order to properly focus the radiating energy on a distant target, the phase delay to all radiating elements must be equalized.

A particular known advantage of array antennas is that they are capable of creating a particularly shaped beam which is well suited to one type of use. An example of this is a narrow pencil beam which is highly directive and has low side lobes such that it is well matched to a pulse doppler air-to-air search and track radar, or to a synthetic aperture ground mapping radar or to a radar with the capability of doppler beam sharpening and/or spotlighting. For other applications, such as ground mapping a beam shape which has return signals of constant power to the receiver independent of range is desirable, this illuminating beam being the well-known $\text{cosec}^2 \theta \cos \theta$ beam.

A number of prior art techniques are known for obtaining multimode operation with a single radar antenna, and each of these techniques has a different trade-off of characteristics, such as beam width, side lobe level, size, cost, etc. One such scheme includes a parabolic reflector with a retractable spoiler extending over part of its surface that redirects a portion of the power toward the ground when fully deployed. Another technique involves the use of a reflector with front and rear surfaces. The front surface is parabolically shaped. The antenna reflects energy with a vertical polarization from the front surface while transmitting horizontally polarized energy from the rear surface to form the ground map beam. Yet another method uses a reflector with two surfaces. The front surface is formed of a microwave transparent plastic material and a metallized rubber skin is positioned between the surfaces. This skin conforms and adheres to one surface or the other depending on the state of pressure differential across the membrane. A particular problem with the aforementioned reflector-type antennas is that they are not generally capable of multimode operation while still providing the required efficiency and low side lobe levels that are necessary to form a good pencil beam. Accordingly, the array antenna is the type of antenna best suited to providing the necessary performance characteristics for multimode use. However, array antennas are not without a number of limitations. An array antenna necessarily requires a large number of phase shifters, as many as one per radiating element, and this component introduces both power losses and phasing errors. Changes in both temperature and power levels to a phase shifter further increase the nature and type of error which must be considered. Probably most significant in airborne operations, are the high weight, massive size and cost of the electronically phased antenna array.

Of interest is another patent application, U.S. patent application Ser. No. 219,744 entitled "Multimode Antenna Array", filed Dec. 23, 1980, by the same inventor which relates to a simple, low cost array antenna for an airborne radar that is capable of providing both a pencil beam and also a $\text{cosec}^2 \theta \cos \theta$ beam. This array antenna includes a single waveguide switch and two waveguide phase shifters that switch the array antenna between its two distinct modes. Unlike the dual switch array antenna described hereinafter, this multimode antenna does not have a monopulse capability in the second of its two modes, the $\text{cosec}^2 \theta \cos \theta$ mode.

DISCLOSURE OF INVENTION

It is an object of the present invention to provide a simple, low cost antenna which has a monopulse capability in both elevation and azimuth in its pencil beam mode and azimuth monopulse capability in its $\text{cosec}^2 \theta \cos \theta$ mode.

According to a feature of the present invention, an array antenna includes two waveguide switches and two waveguide phase shifters, both of which are switches to change the antenna between its two distinct beam modes. A first mode provides a highly directive, narrow beam with low side lobes and monopulse capability in azimuth and elevation. A second mode is a $\text{cosec}^2 \theta \cos \theta$ beam and has a monopulse capability in azimuth.

According to the present invention, an array antenna uses two waveguide switches to shift between a pencil beam with low side lobes and a $\text{cosec}^2 \theta \cos \theta$ beam. The antenna is divided into four quadrants for monopulse operation and, for the $\text{cosec}^2 \theta \cos \theta$ beam, includes two waveguide mounted phase shifters positioned in the feed structure to a single laterally extending stick in each quadrant of the upper half of the antenna.

According to one aspect of the present invention, an array antenna, comprised of a plurality of radiating elements positioned in a planar configuration of four quadrants, is capable of being switched between two modes through the use of two waveguide switches and a pair of phase shifters. The first mode produces a pencil beam with monopulse capability and the switches equally divide the transmit power between the upper and lower halves of the antenna. In this first mode, the two phase shifters are set to zero. To switch to the second mode, the switches are changed to the second position causing the illuminating power to be directed only to an active group of radiating elements in the upper half of the antenna. At the same time the phase shifters are set to introduce a phase shift of approximately 60° to the energy radiating from the radiating elements at the bottom of the active group of sticks in each quadrant. This causes an asymmetric elevation radiation pattern from the antenna which is the well-known $\text{cosec}^2\,\theta \cos\theta$ beam, this beam shape being well suited for ground mapping.

According to the present invention, a four-quadrant array antenna has each of the upper two quadrants divided in two segments by a separated laterally extending stick. Each of these sticks is fed through a waveguide that has a phase shifter mounted thereon. One of the two waveguide switches is positioned in the feed network from the transmitter to each upper segment of each quadrant. In the second mode, the power from the transmitter is diverted to the upper portion of radiating elements in the upper two quadrants of the array antenna causing an asymmetric radiation pattern modified by the phase of the lowest laterally extending stick.

The foregoing and other objects, features and advantages of the present invention will become more apparent from the following description of preferred embodiments and accompanying drawings.

BEST MODE FOR CARRYING OUT THE INVENTION

Figure 1:
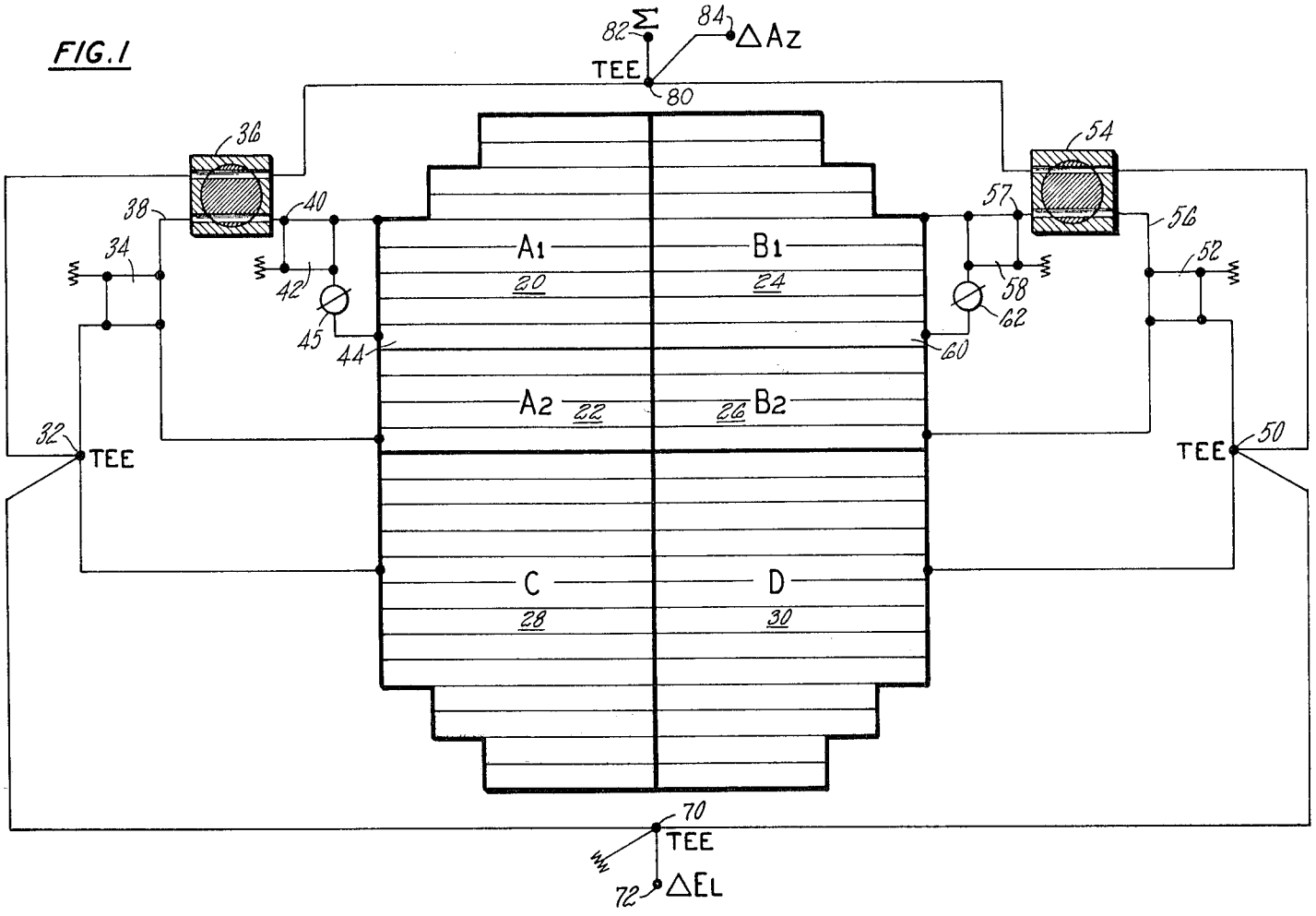
FIG. 1 is a schematic of a dual switch multimode array antenna according to the present invention, and shows the four quadrants of the antenna aperture.

Referring initially to FIG. 1, there is seen a schematic illustration of one embodiment of a dual switch multimode array antenna according to the present invention. This is a relatively large planar array antenna and is capable of being switched between two distinct modes, one of which provides a narrow pencil beam with low side lobes and the other of which provides a $\text{cosec}^2\,\theta \cos\theta$ beam. In addition, the array antenna of the present invention has a monopulse capability in azimuth in this $\text{cosec}^2\,\theta \cos\theta$ mode.

The array antenna is an aperture for electromagnetic energy and is essentially divided into four quadrants, each consisting of a plurality of horizontal waveguide sticks with radiating elements and associated feeds. The upper-left quadrant has an upper section $A_1$ 20 and a lower section $A_2$ 22, the upper-right quadrant has an upper section $B_1$ 24 and a lower section $B_2$ 26, the lower-left quadrant C 28 and the lower-right quadrant D 30. A power divider, such as a magic tee 32, is provided for the left-half of the antenna and has one leg connected to feed the upper-left quadrant of the antenna while the other leg feeds the lower-left quadrant 28 of the array antenna. A directional coupler 34 connected to the magic tee 32 is provided for feeding the upper section 20 and the lower section 22 in this quadrant of the antenna. A first waveguide switch 36 is provided and includes four ports, one of which is connected by a waveguide 38 to the directional coupler 34. A second port is connected by a waveguide 40 to a directional coupler 42. The directional coupler 42 has one leg which feeds all of the radiating elements of the section 20, except the lowest stick 44, and a separate leg which feeds the single stick 44 at the lower end of this section 20. A phase shifter 45 is positioned on the waveguide to the single stick 44.

In a similar fashion a power divider, such as a magic tee 50, is provided for feeding all of the radiating elements in the right-half of the array antenna. The magic tee 50 has one leg connected to feed the radiating elements in the lower-right quadrant 30 while the other leg is connected to a directional coupler 52. One leg of the directional coupler 52 feeds all of the radiating elements in the section 26 while the other leg is connected to a second waveguide switch, waveguide switch 54, by a waveguide 56. A waveguide 57 leads from a second port of the waveguide switch 54 to a directional coupler 58 for feeding all of the radiating elements in the section 24. The directional coupler 58 has one leg which feeds the radiating elements, except a stick 60 at the bottom of this section 24, and another leg which feeds the stick 60. A phase shifter 62 is positioned on the waveguide leading to the stick 60 so that in the $\text{cosec}^2\,\theta \cos\theta$ mode, the phase of the energy presented to this stick can be changed.

Now in order to provide a complete monopulse capability, a power divider, such as magic tee 70, is provided and has one leg connected to the difference port of the magic tee 32 while the other leg is connected to the difference port of the magic tee 50. An elevation monopulse difference port 72 is provided for making monopulse measurements in elevation and is connected to the sum port of the magic tee 70. A power divider, such as magic tee 80, is provided and has one leg which is connected to feed the left quadrant of the antenna and the other leg connected to feed, through the switch 54, the right portion of the antenna. A sum port 82 is provided and is connected to the magic tee 80. An azimuth monopulse difference port 84 is provided for making monopulse measurements in azimuth and is connected to the difference leg of the magic tee 80.

As briefly mentioned herebefore, both the switch 36 and the switch 54 are transitioned between a first and second position to switch the beam of the antenna between its narrow pencil beam and its $\text{cosec}^2\,\theta \cos\theta$ beam mode. In the position shown in FIG. 1, both the switches 36 and 54 are in the pencil mode, and the input power from the transmitter presented to the sum port 82 is equally divided in the magic tee 80 between the left and right-half of the array antenna. The switch 36 and the switch 54 pass this power on to the magic tee 32 and the magic tee 50, respectively. In turn, the magic tee 32 divides this power equally between the upper-left quadrant of the array antenna and the lower-left quadrant of the array antenna. The magic tee 50 divides the power between the upper right quadrant and the lower right quadrant 30 of the array antenna. Thus, the illuminating power directed toward a target is symmetrically divided between the four quadrants of the antenna.

Figure 2:
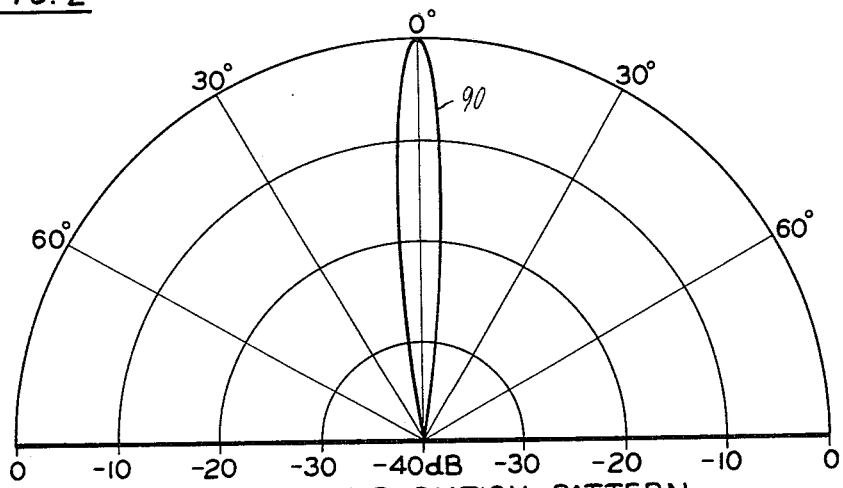
FIG. 2 is a polar plot depicting the elevation and azimuth radiation pattern of the array antenna in one of its two basic modes, the pencil beam mode.

As mentioned, a particular feature of the present invention is to provide a multimode array antenna that has a monopulse capability in azimuth in its $\text{cosec}^2\,\theta \cos\theta$ mode. Referring now to FIG. 2, there is seen a polar plot depicting one of the two radiation patterns of the multimode array antenna according to the present invention, this mode being the pencil beam mode. In this mode, the switches 36 and 54 are in the position shown in FIG. 1 and the radiating aperture of the antenna is essentially symmetric. In other words, the beam as seen from the sum port 82 would appear in both azimuth and elevation as the beam 90. As is seen, the beam 90 generated by the dual switch multimode array antenna is a narrow, pencil beam with extremely low side lobes. In the idealized case as shown, the side lobes are typically below 40 db; but it will be appreciated by those of ordinary skill that in the construction of an antenna in accordance with the present invention, mechanical tolerances are inherent and the resultant phase errors would normally increase the side lobe level.

Figure 3:
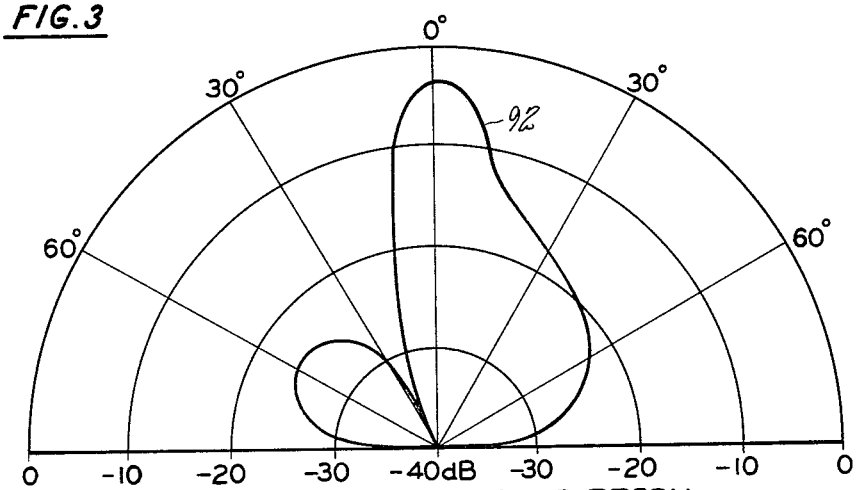
FIG. 3 is a polar plot of the elevation radiation pattern of the dual switch multimode array antenna in the second of its two basic modes, the $\text{cosec}^2\,\theta \cos\theta$ mode.

Referring next to FIG. 3, there is seen a polar plot of the radiation pattern in elevation of the dual switch multimode antenna according to the present invention in the second of the two modes, the $\text{cosec}^2\,\theta\,\cos\theta$ mode. The beam 92 is particularly well suited for use in ground mapping because the returns are of relatively constant intensity from low elevation angles out to the horizon. In this mode, the switches 36 and 54 (FIG. 1) have been transitioned to their second position in which the directional couplers 42 and 58 are connected directly to the magic tee 80. With the switches in this position, incoming power from the transmitter connected to the sum port 82 is presented to only the upper radiating elements of the top two quadrants of the antenna, these being the radiating elements in the sections 20 and 24. Simultaneously with the transition of the two switches, the phase shifters 45 and 62 are set such that a phase shift of approximately 60° is introduced into the propagation path to the sticks 44 and 60. Although the phase shifters 45 and 62 are set to approximately 60° to obtain the usually preferred $\text{cosec}^2\,\theta\,\cos\theta$ pattern as shown in FIG. 3, it should be understood that other settings are possible. For example, variations of between 30° and 120° of phase provide a pattern control that is often desirable when operating at different altitudes.

Figure 4:
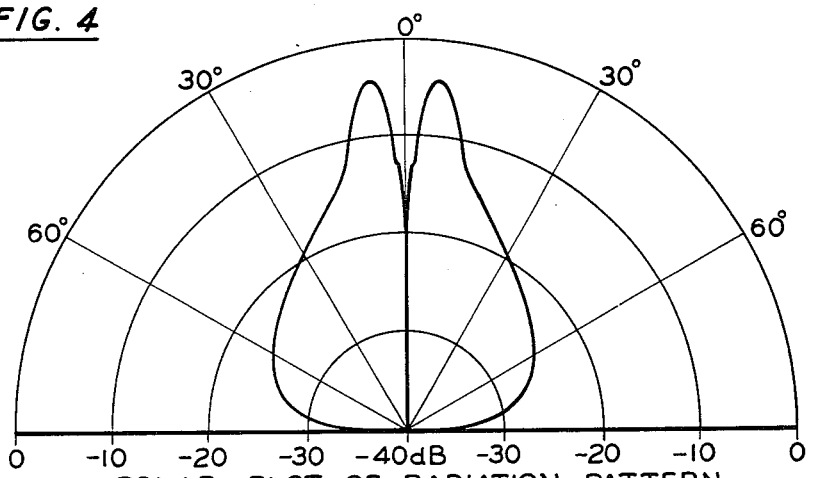
FIG. 4 is a polar plot showing the monopulse azimuth difference radiation pattern with the antenna in the $\text{cosec}^2\,\theta \cos\theta$ mode and the elevation and azimuth difference radiation pattern in the pencil beam mode.

Referring now to FIG. 4, there is seen a polar plot of the monopulse difference patterns of the dual switch multimode array antenna according to the present invention. A particular feature of the present invention is that this monopulse difference pattern is available in azimuth in the $\text{cosec}^2\,\theta\,\cos\theta$ mode. Of course, this is significant because it allows monopulse measurements to be made from the azimuth monopulse difference port 84 when the antenna is being used for ground mapping, or the like.

it will be appreciated by those of ordinary skill that the particular embodiment illustrated here shows the switches 36 and 54 as waveguide transfer switches and phase shifters 45 and 62 may be dielectric cards inserted in the waveguides. However, for rapid mode switches, the just mentioned components may be too slow and electronic switches and phase shifters that make use of ferrite or diode elements would be more suitable.

Figure 5:
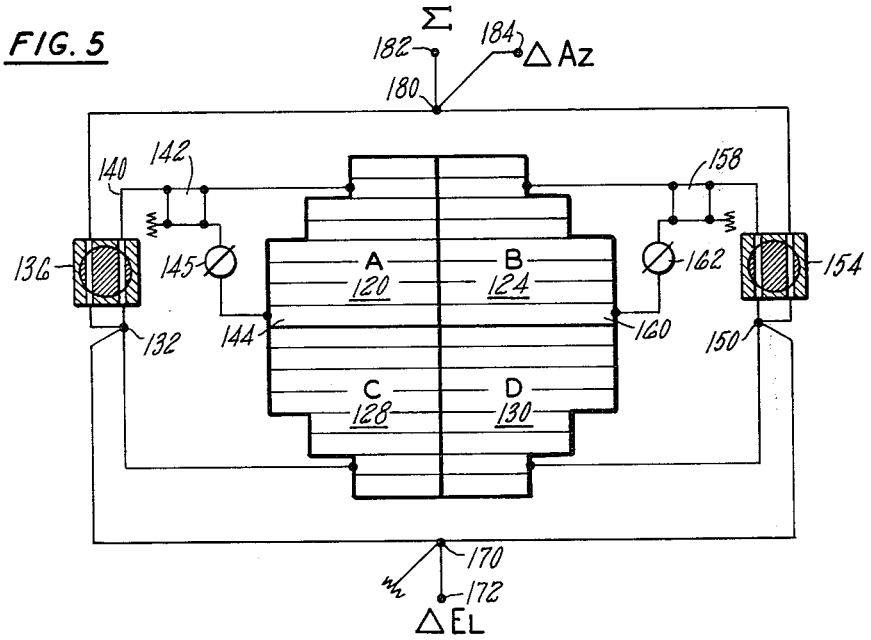
FIG. 5 is a schematic of a second embodiment of a dual switch multimode array antenna according to the present invention, this embodiment typically having a smaller aperture.

Referring now to FIG. 5, there is seen another embodiment of a dual switch multimode antenna according to the present invention. It can be noted that this second embodiment is quite similar to the first embodiment shown in FIG. 1, but this embodiment is for an array antenna having a smaller overall aperture size. This embodiment is also capable of being switched between two distinct modes, one of which provides a narrow pencil beam with low side lobes and the other of which provides a $\text{cosec}^2\,\theta\,\cos\theta$ beam. As before, this embodiment of the dual switch multimode array antenna has a monopulse capability in azimuth in this $\text{cosec}^2\,\theta\,\cos\theta$ mode.

The aperture for electromagnetic energy of this embodiment is essentially divided into four quadrants, each consisting of a plurality of sticks with radiating elements and associated feeds. The aperture includes an upper-left quadrant, quadrant A 120, an upper-right quadrant, quadrant B 124, a lower-left quadrant, quadrant C 128 and a lower-right quadrant, quadrant D 130. A power divider, such as magic tee 132, is provided for feeding the two left quadrants, quadrant A 120 and quadrant C 128, and has one leg connected to feed each quadrant. A first waveguide switch 136 is provided and includes four ports, one of which is connected to the magic tee 132. A second port is connected by a waveguide 140 to a directional coupler 142. The directional coupler has one leg which feeds all of the sticks of radiating elements in the quadrant A 120, except the bottom stick 144. A separate leg from the directional coupler 142 feeds this lower stick 144 at the bottom of the quadrant A 120. A phase shifter 145 is positioned on the waveguide leading to this lower stick 144.

In a similar fashion, a power divider, such as magic tee 150 is provided for feeding all of the radiating elements in the right half of the array antenna, those in the quadrant B 124 and the quadrant D 130. The magic tee 150 has one leg connected to feed all of the sticks of radiating elements in the quadrant D 130 while another leg leads to a port on a second waveguide switch 154. Another port of the second waveguide switch 154 leads to a directional coupler 158 which feeds all of the sticks of radiating element in the quadrant B 124. One leg of the directional coupler 158 feeds all of the sticks of radiating elements in the quadrant 124, except the stick 160, which extends along the bottom of this quadrant. Another leg from the directional coupler 158 feeds this bottom stick 160 and a phase shifter 162 is positioned thereon.

As before, this second embodiment includes a power divider, such as magic tee 170, and it has one leg connected to the difference port of magic tee 132 while another leg is connected to the difference port of the magic tee 150. An elevation monopulse difference port 172 is provided for making monopulse measurements in elevation and is connected to the sum port of the magic tee 170. A power divider, such as magic tee 180, is provided and has one leg connected to feed the left quadrants, quadrant A 120 and quadrant C 128, through the switch 136. In a similar fashion, another leg from the magic tee 180 is connected to feed, through the switch 154, the right quadrants of the antenna, quadrant B 124 and quadrant D 130. A sum port 182 is provided and is also connected to one leg of the magic tee 180. An azimuth monopulse difference port 184 is provided for making monopulse measurements in azimuth and is connected to the difference leg of the magic tee 180.

As mentioned, the operation of this second embodiment of a dual switch multimode array antenna is identical to the first embodiment as described herebefore. As would be expected, the radiation patterns of this embodiment of the multimode array antenna are quite similar to that of the first embodiment and thus, FIGS. 2–4 are polar plots that generally depict these radiation patterns. Of course, because this second embodiment is for an aperture size which is smaller than the first embodiment, the performance characteristics are correspondingly down-sized. All of the engineering tradeoffs associated with a smaller aperture size are well known to those of ordinary skill.

Although this invention has been shown and described with respect to a preferred embodiment, it will be understood by those skilled in this art that various changes in form and detail thereof may be made without departing from the spirit and scope of the claimed invention.

I claim:

1. An array antenna connectable to an input/output port forming an aperture to transmit or receive radar signals, said array antenna being switchable between at least two modes, comprising:

aperture means divided into four quadrants, two of said quadrants forming the upper portion of said aperture means, and two of said quadrants forming the lower portion of said aperture;

a feed means connected between said input/output port and said aperture means, including a first power divider means connected to divide the energy of an illuminating radar signal between, or for combining the energy of a received radar signal from, two of said quadrants forming the left-half and the right-half of said aperture;

azimuth monopulse difference port means connected to said first power divider;

switch means connected between said first power divider means and the said quadrants forming each half of said aperture, said switch means having a first and second position; and whereby with each of said switch means in said first position, said input/output port is connected such that a radar signal is either presented to, or received from, all of the said quadrants equally, however, with said switch means in said second position, said input/output port is connected to only at least a portion of two quadrants forming one-half of said aperture means.

2. An array antenna according to claim 1, wherein there are two upper intermediate feed means and also two lower intermediate feed means, each of which is connected to a power combiner/divider.

3. An array antenna according to claim 1, further including a phase shift means positioned in the feed path to a waveguide stick at the lower end of each of said quadrants forming said upper portion of said aperture means, and wherein said phase shift means is transitioned between a first position and a second position simultaneously with said switch means such that in said first position said phase shift means causes no phase shift in the radar signal to, or from, the waveguide sticks at the lower end of said upper portion of said aperture means, and in the second position said phase shift means causes a phase shift in the radar signal to said waveguide sticks at the lower end of said upper portion of said aperture means.

4. An array antenna according to claim 3, wherein said phase shift introduced by said phase shift means in said second position is approximately 60°, but may be varied between 30° and 120°.

5. An array antenna according to claim 3, wherein there are two upper intermediate feed means, and wherein each includes a mounting upon which said phase shift means can be attached.

6. An array antenna according to claim 1, wherein an elevation monopulse difference port is connected to said difference port of said first power combiner for making monopulse elevation measurements.

7. An array antenna according to claim 1, wherein said switch means includes a first switch and a second switch, each of which is transitioned between said first position and said second position to switch said antenna between its two modes.

8. An array antenna according to claim 1, wherein said first mode is a pencil beam mode with low side lobes and monopulse capability.

9. An array antenna according to claim 1, wherein said second mode is a $\text{cosec}^2\,\theta \cos\theta$ mode.

* * * * *

UNITED STATES PATENT AND TRADEMARK OFFICE

CERTIFICATE OF CORRECTION

PATENT NO. : 4,359,742

DATED : November 16, 1982

INVENTOR(S) : PETER W. SMITH

It is certified that error appears in the above-identified patent and that said Letters Patent is hereby corrected as shown below:

Column 1, line 11, "η" should be --θ--

Column 4, line 51, "in" should be -- by --

Signed and Sealed this

*Thirteenth* Day of *September 1983*

[SEAL]

*Attest:*

GERALD J. MOSSINGHOFF

*Attesting Officer*

*Commissioner of Patents and Trademarks*